US005124502A

United States Patent [19]

Nelson et al.

[11] Patent Number: 5,124,502

[45] Date of Patent: Jun. 23, 1992

[54] METHOD OF PREPARATION OF PHENYLALKYLSILANES

[75] Inventors: Gunner E. Nelson; John G. Loop, both of Baton Rouge, La.

[73] Assignee: Ethyl Corporation, Richmond, Va.

[21] Appl. No.: 636,756

[22] Filed: Jan. 2, 1991

[51] Int. Cl.[5] ..... C07F 7/08
[52] U.S. Cl. ..... 556/478
[58] Field of Search ..... 556/478

[56] References Cited

U.S. PATENT DOCUMENTS

| | | | |
|---|---|---|---|
| 4,595,777 | 6/1986 | Bakshi et al. | 556/478 |
| 4,711,965 | 12/1987 | Nelson | 556/478 |
| 4,916,245 | 4/1990 | Nelson | 556/478 |

*Primary Examiner*—Paul F. Shaver
*Attorney, Agent, or Firm*—Terry B. Morris; David E. LaRose

[57] ABSTRACT

New methods of producing phenylalkylsilanes having a desired ration of phenyldialkylsilanes to phenyltrialkylsilanes using effective control of temperature in the reaction of sodium trialkylaluminum and phenyltrihalosilanes are disclosed.

23 Claims, No Drawings

METHOD OF PREPARATION OF PHENYLALKYLSILANES

BACKGROUND

Various synthetic fluids, including synthetic hydrocarbons and silahydrocarbons, which are stable at high temperatures, have been developed which are useful in the formulation of hydraulic fluids and lubricants, among other uses. Multiple substituted silanes, and in particular tetrasubstituted-silanes, have been proposed for the use in the formulation of hydraulic fluids and lubricants since they possess excellent viscosities, low pour points, and excellent thermal stability over a wide temperature range.

Various methods for the synthesis of tetraalkyl-substituted silanes possessing desired properties involve the addition of a Grignard reagent or alkyllithium compounds to alkyltrichlorosilanes, such as shown in U.S. Pat. No. 4,367,343. Other methods of making silahydrocarbons from alkylchlorosilanes are reported, such as in U.S. Pat. No. 4,595,777, in which an alkylchlorosilane having the formula $R_xSiCl_{(4-x)}$, wherein R is an alkyl radical, and a trialkylaluminum compound having the formula $AlR_1R_2R_3$, wherein $R_{1-3}$ are the same or different alkyl radicals, produce a desired tetraalkylsilane product having the general formula $RSiR_1R_2R_3$. However, nothing is taught as to the control of particular proportions of the possible various different reaction product.

U.S. Pat. Nos. 4,572,791 and 4,578,497 teach the preparation of silahydrocarbons including dialkylsilanes having the formula $SiH_2R_2$ and trialkylsilanes having the formula $RSiH(R_1)_2$ wherein R and $R_1$ are alkyl radicals from 1 to 20 carbon atoms. However, such reactions were catalyzed reactions utilizing rhodium or platinum catalysts.

Because the properties of the silahydrocarbon depends in part upon the proportions of such product mixtures, such as proportions of dialkylsilanes to trialkylsilanes, then it would be advantageous to have methods which could effectively control the proportions of such product mixtures.

SUMMARY

New methods have been invented comprising the control of temperatures in the reaction of sodium tetraalkylaluminums and phenyltrihalosilanes to produce a mixture of phenyldialkylsilanes and phenyltrialkylsilanes products wherein the ratios of such products are effectively controlled.

DESCRIPTION OF THE PREFERRED EMBODIMENTS

One embodiment of the present invention is a method of producing a desired ratio of phenyldialkylsilanes to phenyltrialkylsilanes, which silanes are formed by the reaction of sodium tetraalkylaluminums and phenyltrihalosilanes. This method comprises the effective control of temperature to produce the desired ratios of phenyldialkylsilanes to phenyltrialkylsilanes. It has unexpectedly been discovered that desired product ratios can be attained using effective control of temperature in the above reaction.

Such effective control schemes can comprise maintaining initial temperatures lower than the subsequent temperatures of the reaction. For instance, one embodiment of the present invention embodies the effective control of temperature by ramping (e.g., increasing or decreasing) the temperature of the reaction of sodium tetraalkylaluminum and phenyltrihalosilane. Ramping of the temperature can be performed in either continuous or a discrete manner.

For example, from an initial reaction temperature (e.g., conveniently room temperature) the reaction temperature can be controlled to continuously increase during the reaction cycle. This increase in temperature can be a linearly or curvilinearly sloped increase and continue up to a maximum temperature to effectively produce the desired ratio of products. A curvilinear slope can also be positively accelerated or negatively accelerated (decelerated) at various times of the reaction cycle.

In comparison, in an example of a discrete manner of temperature control, the temperature of the reaction can be initially held at a set temperature for a period of time. After this first period of time the temperature can then be controlled to rise (e.g. ramp) to another temperature set point. At that second set point the temperature can then be held at a constant temperature for another period of time. As will be illustrated in the examples below, control of the relative temperatures and periods of time can effect the proportions of dialkylphenylsilanes to trialkylphenylsilanes produced. Accordingly, an embodiment of the present invention comprises effective control of temperature comprising ramping the temperature of the reaction for at least one period of time.

Two or more periods of time can be used for ramping. A cycle of effective control of the temperature of the reaction in accordance with embodiments of the present invention can comprise several steps or subcycles of holding the temperature for a period of time and ramping the temperature for a period of time to another temperature set point. For example, several subcycles such as the cycle just illustrated, can be performed for one overall cycle of temperature control during the reaction. This would involve an initial holding period, followed by a ramping period, followed another holding period, followed by another ramping period, and such holding and ramping continuing as needed to effect the product ratio desired. It is recognized that the rate of ramping of the temperature, that is the increase in degrees of temperature per unit of time (e.g., degrees centigrade per minute), can be either a constant or a variable rate during the ramping period. That is, the rate of change of temperature can be constant or, for example, it can initially be a relatively slow rate of increase followed by a period of relatively fast rate of increase and then possibly followed by another relatively slow period of increase up to a particular temperature set point for holding.

Therefore, one embodiment of the present invention comprises the effective control of the ratios of products produced comprising the ramping of the temperature of the reaction of sodium tetraalkylaluminum and phenyltrihalosilane for at least one period of time. Another embodiment further comprises holding the temperature of the reaction for at least one period of time. As previously discussed, embodiments can also comprise a cycle of at least two sequential subcycles of periods of ramping and holding of the temperature of the reaction. These sequential periods of ramping preferably elevate the reaction temperature as time increases. However, possible periods of decreasing the temperature for a time can also be performed.

The product produced by the effective control of temperature is a product mixture of alkylsilanes comprising phenyldialkylsilanes and phenyltrialkylsilanes wherein the ratio of phenyldialkylsilanes to phenyltrialkylsilanes preferably ranges from about 0.95 to about 0.001. More preferably the method produces a product wherein such ratio ranges from about 0.5 to about 0.01, most preferably from about 0.2 to about 0.05.

The alkyl groups of the phenyldialkylsilanes and phenyltrialkylsilanes produced by the present invention are each independently selected from alkyl groups preferably having from about four to about twenty carbon atoms each (e.g., $-C_nH_{2n+1}$, wherein n ranges from about 4 to about 20). Preferably such alkyl groups are normal alkyl groups (e.g., straight-chained alkyl groups, such as n-hexyl, and not branched alkyl groups, such as 4-methylpentyl). More preferably each alkyl group is independently selected from normal alkyl groups having from about six to about twelve carbon atoms each; e.g., hexyl, heptyl, octyl, nonyl, decyl and dodecyl groups. It is most preferred that the alkyl groups have approximately about the same number of carbon atoms. Accordingly, it is most preferred that either (a) each alkyl group is independently selected from alkyl groups having from about six to about eight carbon atoms each or (b) each alkyl group is independently selected from alkyl groups having from about eight to about ten carbon atoms each or (c) each alkyl group is independently selected from alkyl groups having from about ten to about twelve carbon atoms each. One preferred embodiment is a method wherein each alkyl group is an n-hexyl group (e.g., $-CH_2CH_2CH_2CH_2CH_2CH_3$).

When the reactants are constituted of more than one kind of alkyl group, then more than one kind of alkyl group can be present in the products produced. For example, when reactants constitute alkyl groups of hexyl and octyl groups (such as when reacting a mixture of sodium dihexyldioctylaluminum and phenyltrichlorosilane), the product can have a mixture of phenyldialkylsilanes and phenyltrialkylsilanes (e.g. phenyldihexylsilane, phenyldioctylsilane, phenylhexyloctylsilane, phenylhexyldioctylsilane, phenyloctyldihexylsilane, phenyltrioctylsilane and phenyltrihexylsilane) in various proportions.

Preferably the halogen atoms of the phenyltrihalosilanes are chlorine atoms, e.g. the preferred phenyltrihalosilane is phenyltrichlorosilane ($C_6H_5SiCl_3$). One preferred method of the present invention is the control of the ratio of phenyldihexylsilane to phenyltrihexylsilane produced in the reaction of sodium tetrahexylaluminum and phenyltrichlorosilane, which method comprises effectively controlling the temperature of the reaction to produce the ratio. Most preferably, the hexyl groups are n-hexyl groups. The temperatures can range from ambient temperatures or lower to a maximum temperature of the decomposition temperature of the reactants and products. A preferred temperature range is from about 25° C. to about 250° C. More preferably the temperature is at most about 200° C. In this preferred embodiment the temperature is ramped increasingly for at least one period of time during the reaction. Ramping can be preformed such that the temperature is substantially continuously ramped increasingly during the reaction. Therefore, one preferred embodiment is effective control of the temperature wherein the initial temperature of the reaction is about 25° C. and is continuously ramped upward increasingly to about 200° C. during the reaction time.

The temperature can be ramped preferably at a rate of from about 0.5° C. to about 5° C. per minute. The ramping rate can be substantially constant throughout the reaction. However, a cycle of temperature ramping can comprise at least two periods each of ramping and at least one period of time, intermediate or sequential to the ramping periods, of holding the reaction temperature. For example, the reaction temperature can be controlled at one rate up to a certain (set point) temperature, followed by holding at that temperature for an intermediate period of time, followed by ramping at a different rate than that previous to a final set point temperature, at which instance the reaction may be deemed completed or such temperature can be held for a period of time for further reaction. Accordingly the rate of ramping can be greater or lesser each period of ramping than the previous ramping rate to effect the attainment of a particular product ratio.

The pressures used in the reactions can be any convenient pressures inasmuch as the pressures used do not appear to be materially effective in the ratios attained by the present invention. Since closed systems can be used, the pressures of the reaction systems can be expected to fluctuate (e.g., rise) during the reaction cycle in such systems.

The reaction can be performed neat or in a solvent system. The solvent used should be one compatible with the reactants and products formed. Organic solvents such as alkenes and paraffinic solvents are preferred. Conveniently, the solvent chemical can be similar to the alkyl groups used. For instance, in the below examples 1-hexene is used in reaction systems in which hexyl groups are present in the reactants and products.

The following examples illustrate the present invention, but are not intended to limit or restrict the present invention.

Experiment I

Preparation of Sodium Tetrahexylaluminum

A glovebox system was prepared for reaction of sodium aluminum hydride and lithium aluminum hydride by purging with a nitrogen atmosphere. Into the glovebox was put a one liter PARR autoclave which had been thoroughly washed, dried and purged with dry nitrogen. 410 grams (4.9 moles) of 1-hexene was poured into the autoclave. 27.0 grams (0.5 moles) of sodium aluminum hydride and 2.0 grams (0.05 moles) of lithium aluminum hydride were added to the autoclave. The autoclave was secured airtight and removed to a large heated jacket fixed with a thermocouple and water cooling lines. A heating controller for the jacket was programmed for the following temperatures during the reaction cycle:

Initial set point—25° C.

Ramp 1—25° C. to 125° C. in one hour (1.67° C./minute rate)

Hold 1—hold at 125° C. for two hours

Ramp 2—125° C. to 175° C. in 0.5 hours (1.67° C./minute rate)

Hold 2—hold at 175° C. for three hours

Ramp 3—175° C. to 20° C. spontaneously (autoclave cool down)

After the program was set, stirring was performed at a moderate rate. The cycle was allowed to run to completion and stirring performed overnight as the autoclave cooled. A grayish-black viscous liquid product formed and was transferred to a one liter glass bottle. Analysis showed that the product formed was sodium tetrahexylaluminum.

Experiment 2

First preparation of phenylalkylsilanes 0.244 moles of sodium tetrahexylaluminum was mixed with 200 grams of 1-hexene solvent and then admixed with 0.271 moles of phenyltrichlorosilane in a one liter PARR reactor. The admixture was heated under agitation for 5 hours at 190° C. The reaction mixture was then cooled and hydrolyzed by admixing slowly to 500 milliliters of a 25% sodium caustic solution. The organic phase was separated and washed with 250 milliliters of 25% caustic solution. Rinsing several times with water was then performed to remove the caustic.

Gas-liquid chromotography of the reaction products showed the formation of two major products, which products were confirmed by gas chromotography/mass spectrometry analysis as being phenyldihexylsilane and phenyltrihexylsilane. The ratio of phenyldihexylsilane to phenyltrihexylsilane was 0.84.

Experiment 3

Second preparation of phenylalkylsilanes

An experiment was performed as in Experiment 2 with the exception that the admixture was initially heated at 125° C. for two hours and then heated at 185° C. to 190° C. for four hours. Analysis of the product showed a ratio of phenyldihexylsilane to phenyltrihexylsilane of 0.64. Upon distillation of the product mixture, 18.7 grams of the phenydihexylsilane (b.p. 130° to 132° C. at 0.8 millimeters pressure) and 47.5 grams of the phenyltrihexylsilane (b.p. 144 to 148° C. at 0.15 mm) were obtained, which equated to a yield of 20.7% for the phenyldihexylsilane and a yield of 40.3% of the phenyltrihexylsilane.

Experiment 4

Third preparation of phenylalkylsilanes

An experiment was performed as in experiment 2 with the exception that the heating of the mixture was initially heated at 85° C. for 1 hour, then heated at 125° C. for 1 hour, then heated at 150° C. for 1.5 hours, and finally heated at 190° C. for 4 hours. Analysis of the resulting product showed a ratio of phenyldihexylsilane to phenyltrihexylsilane of 0.22.

Distillation of the phenyltrihexylsilane from the product was performed and analysis of the distilled product's physical properties obtained are presented in Table I.

TABLE I

| Product Physical Properties | |
|---|---|
| Property | Value (Duplication Value) |
| Oxidation Onset Temperature (°C.) | 197.4 (197.7) |
| Energy (kJ/g) | 7.5 (7.2) |
| Viscosity (cSt) at | |
| −54° C. | 5220 |
| −40° C. | 1060 |
| +40° C. | 9.19 |
| +100° C. | 2.42 |
| Pour Point (°C.) | <−65 |

TABLE I-continued

| Product Physical Properties | |
|---|---|
| Property | Value (Duplication Value) |
| Specific Gravity at | |
| 15.6° C. | 0.8693 |
| 25° C. | 0.8649 |
| Temperature (°C.) at weight loss of | |
| 5% | 199.9 (195.4) |
| 50% | 255.8 (253.0) |
| 95% | 277.2 (318.9) |
| Viscosity Index | 74 |

Experiment 5

Fourth preparation of phenylalkylsilanes 187.4 grams (0.48 moles) of sodium tetrahexylaluminum as a 51.3 weight percent solution in 1-hexene were admixed with 112.5 grams (0.53 moles) of phenyltrichlorosilane in a one liter reactor autoclave within a nitrogen atmosphere glovebox. The autoclave was transferred to a heating jacket with programmable heating control and heating was performed under the following cycle:

| Set Point | Temp. (°C.) | Time (min.) | Rate or Dwell |
|---|---|---|---|
| 0 | 25 | — | none |
| 1 | 60 | 20 | 1.75° C./min |
| 2 | 60 | 40 | hold |
| 3 | 125 | 20 | 3.25° C./min |
| 4 | 125 | 70 | hold |
| 5 | 190 | 30 | 2.17° C./min. |
| 6 | 190 | 240 | hold |
| 7 | 15 | (autoclave cool down) | |

The reaction mixture was agitated at moderate pace during the heating and cooling cycle. The reaction mixture was hydrolyzed by admixing slowly with 1 liter of 25% caustic solution.

After hydrolyzing, the aqueous layer was removed in a separatory funnel. The organic phase was washed several times with tap water. Heptane was added to the separatory funnel after the first wash to increase the organic phase and to obtain a better separation. Filtering through celite was performed to remove solids and the product was placed in a large Erlenmeyer flask over approximately 7 to 10 grams of magnesium sulfate, $MgSO_4$. The product was allowed to dry overnight in the flask.

When the drying was completed, the product was distilled to remove lower boiling organics and by-products of the reaction. Gas chromotography analysis of the product showed a ratio of phenyltrihexylsilane to phenyldihexylsilane of 59/4.

The following Table II summarizes the experimental results:

TABLE II

| Experiment | Dihexylphenylsilane/ Trihexylphenylsilane | Trihexylphenylsilane/ Dihexylphenylsilane |
|---|---|---|
| 2 | 0.84 | 1.2 |
| 3 | 0.64 | 1.6 |
| 4 | 0.22 | 4.6 |
| 5 | 0.07 | 14.8 |

What is claimed is:

1. A method of producing a desired ratio of phenyldialkylsilanes to phenyltrialkylsilanes which are formed by the reaction of sodium tetraalkylaluminums and phenyltrihalosilanes, said method comprising effectively controlling reaction temperature thereby producing said ratio wherein said ratio is in the range of from about 0.95 to about 0.001.

2. The method of claim 1 wherein each alkyl group of said phenyldialkylsilanes and phenyltrialkylsilanes is independently selected from alkyl groups having from about four to about twenty carbon atoms each.

3. The method of claim 2 wherein each alkyl group is independently selected from alkyl groups having from about six to about ten carbon atoms each.

4. The method of claim 3 wherein each alkyl group is independently selected from alkyl groups having from about six to about eight carbon atoms each.

5. The method of claim 3 wherein each alkyl group is independently selected from alkyl groups having from about eight to about ten carbon atoms each.

6. The method of claim 3 wherein each alkyl group is an n-hexyl group.

7. The method of claim 1 wherein the halogen atoms of the phenyltrihalosilane are chlorine atoms.

8. The method of claim 1 wherein effective control of temperature comprises ramping upward the temperature of the reaction for at least one period of time wherein initial reaction temperatures are lower than subsequent reaction temperatures.

9. The method of claim 8 further comprising holding the temperature of the reaction for at least one period of time.

10. The method of claim 9 comprising a cycle of at least two alternating periods of ramping and holding the temperature of the reaction.

11. The method of claim 9 wherein the alternating periods of ramping and holding produces sequential periods of ramping wherein subsequent reaction temperatures are higher than previous reaction temperatures.

12. The method of claim 1 wherein said reaction temperature is effectively controlled by maintaining initial reaction temperatures lower than subsequent reaction temperatures.

13. The method of claim 11 wherein the ratio ranges from about 0.5 to about 0.01.

14. The method of claim 13 wherein the ratio ranges from about 0.2 to about 0.05.

15. A method of claim 1 wherein the sodium tetraalkylaluminum is sodium tetrahexylaluminum and the phenyltrihalosilane is phenyltrichlorosilane.

16. The method of claim 15 wherein the temperature ranges from about 25 degrees centigrade to about 250 degrees centigrade.

17. The method of claim 16 wherein the temperature is at most about 200 degrees centigrade.

18. The method of claim 15 wherein the temperature is ramped upward increasingly for at least one period of time during the reaction wherein subsequent reaction temperatures are higher than previous reaction temperatures.

19. The method of claim 15 wherein the temperature is substantially continuously ramped upward increasingly during the reaction wherein subsequent reaction temperatures are higher than previous reaction temperatures.

20. The method of claim 15 wherein the temperature is ramped upward at a rate of from about 0.5 degrees centigrade to about 5 degrees centigrade per minute wherein subsequent reaction temperatures are higher than previous reaction temperatures.

21. The method of claim 20 wherein the ramping rate is substantially the same throughout the reaction.

22. The method of claim 15 wherein a cycle comprising at least two periods each of ramping upward reaction temperatures and at least one period of holding of the reaction temperature is performed wherein subsequent reaction temperatures are higher than previous reaction temperatures.

23. The method of claim 22 wherein the rate of ramping is greater each period of ramping than the previous ramping rate.

* * * * *